US006765183B1

(12) United States Patent
Torres

(10) Patent No.: US 6,765,183 B1
(45) Date of Patent: Jul. 20, 2004

(54) MICROWAVE OVEN FOOD AND DRINK ENCLOSURE ASSEMBLY

(76) Inventor: Christopher J. Torres, 1555 Sky Valley Dr., #JJ103, Reno, NV (US) 89503

( * ) Notice: Subject to any disclaimer, the term of this patent is extended or adjusted under 35 U.S.C. 154(b) by 0 days.

(21) Appl. No.: 10/461,910

(22) Filed: Jun. 16, 2003

(51) Int. Cl.[7] ..... H05B 6/80

(52) U.S. Cl. ..... 219/756; 219/725; 219/762; 126/39 M; 99/DIG. 14

(58) Field of Search ..... 219/725, 756, 219/391, 392, 395, 762; 126/39 M; 99/DIG. 14, 4, 451

(56) References Cited

U.S. PATENT DOCUMENTS 3,679,855 A * 7/1972 Binzer ..... 219/740
4,051,341 A * 9/1977 Tanaka et al. ..... 219/740
4,633,052 A * 12/1986 Beavers et al. ..... 219/733
4,778,968 A * 10/1988 Torres ..... 219/725
5,290,985 A * 3/1994 Jancic et al. ..... 219/725
D353,512 S * 12/1994 Saimen et al. ..... D7/351
5,927,266 A * 7/1999 Maugard ..... 126/39 M
6,137,097 A * 10/2000 Smith et al. ..... 219/725

FOREIGN PATENT DOCUMENTS

GB 2 331 357 * 5/1999

* cited by examiner

*Primary Examiner*—Philip H. Leung

(57) ABSTRACT

A microwave oven food & drink enclosure assembly for keeping the insides of the microwave oven clean from splatters. The microwave oven food & drink enclosure assembly includes a plurality of panels being detachably attached to form an enclosure in which food and drink can be supported in a microwave oven to keep interior walls of the microwave oven clean during the use thereof; and also includes an assembly of connecting the panels together.

5 Claims, 5 Drawing Sheets

MICROWAVE OVEN FOOD AND DRINK ENCLOSURE ASSEMBLY

BACKGROUND OF THE INVENTION

1. Field of the Invention

The present invention relates to food & drink enclosures for microwave ovens and more particularly pertains to a new microwave oven food & drink enclosure assembly for keeping the insides of the microwave oven clean from splatters.

2. Description of the Prior Art

The use of food & drink enclosures for microwave ovens is known in the prior art. More specifically, food & drink enclosures for microwave ovens heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,679,855; U.S. Pat. No. 4,633,052; U.S. Pat. No. 4,778,968; U.S. Pat. No. 4,051,341; U.S. Pat. No. 6,137,097; and U.S. Pat. No. Des. 353,512.

While these devices fulfill their respective, particular objectives and requirements, the aforementioned patents do not disclose a new microwave oven food & drink enclosure assembly. The prior art includes window protectors, liner bags and screens used in microwave ovens.

SUMMARY OF THE INVENTION

The general purpose of the present invention, which will be described subsequently in greater detail, is to provide a new microwave oven food & drink enclosure assembly which has many of the advantages of the food & drink enclosures for microwave ovens mentioned heretofore and many novel features that result in a new microwave oven food & drink enclosure assembly which is not anticipated, rendered obvious, suggested, or even implied by any of the prior art food & drink enclosures for microwave ovens, either alone or in any combination thereof. The present invention includes a plurality of panels being detachably attached to form an enclosure in which food and drink can be supported in a microwave oven to keep interior walls of the microwave oven clean during the use thereof; and also includes an assembly of connecting the panels together. None of the prior art includes the combination of the elements of the present invention.

There has thus been outlined, rather broadly, the more important features of the microwave oven food & drink enclosure assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new microwave oven food & drink enclosure assembly which has many of the advantages of the food & drink enclosures for microwave ovens mentioned heretofore and many novel features that result in a new microwave oven food & drink enclosure assembly which is not anticipated, rendered obvious, suggested, or even implied by any of the prior art food & drink enclosures for microwave ovens, either alone or in any combination thereof.

Still another object of the present invention is to provide a new microwave oven food & drink enclosure assembly for keeping the insides of the microwave oven clean from splatters.

Still yet another object of the present invention is to provide a new microwave oven food & drink enclosure assembly that is easy and convenient to set up and use.

Even still another object of the present invention is to provide a new microwave oven food & drink enclosure assembly that allows the user to remove the enclosure and detach the panels and wash and clean the panels more easily than the user trying to wash and clean the walls of the microwave oven.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
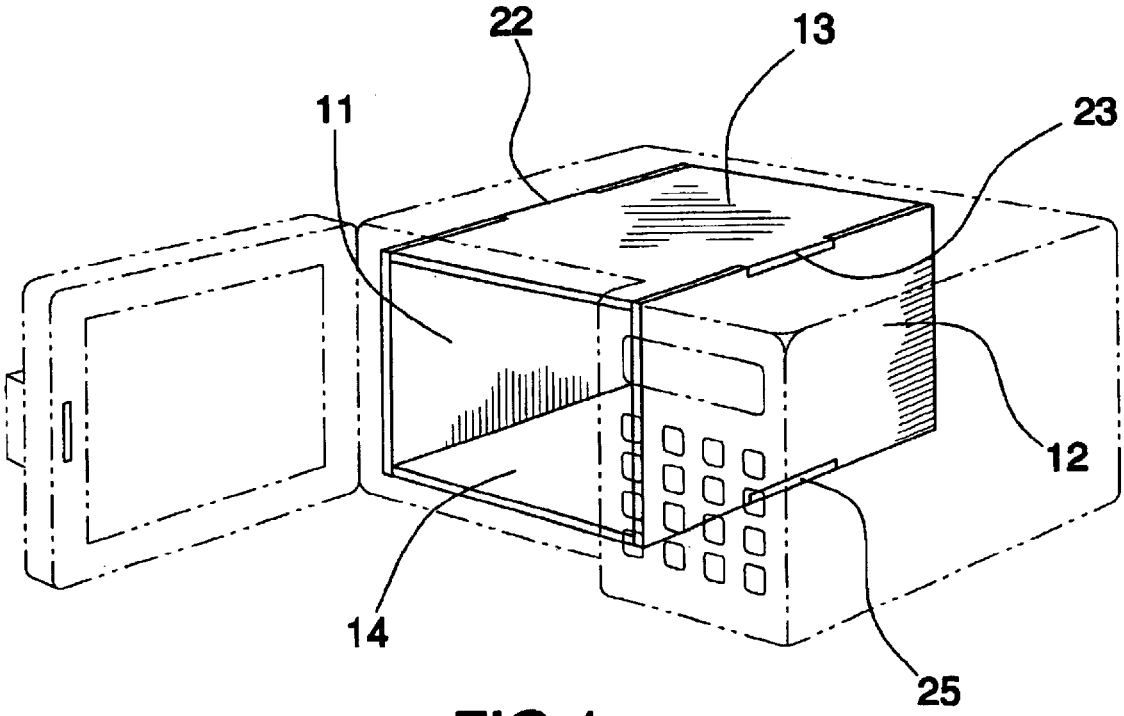
FIG. 1 is a perspective view of a new microwave oven food & drink enclosure assembly according to the present invention.
Figure 2:
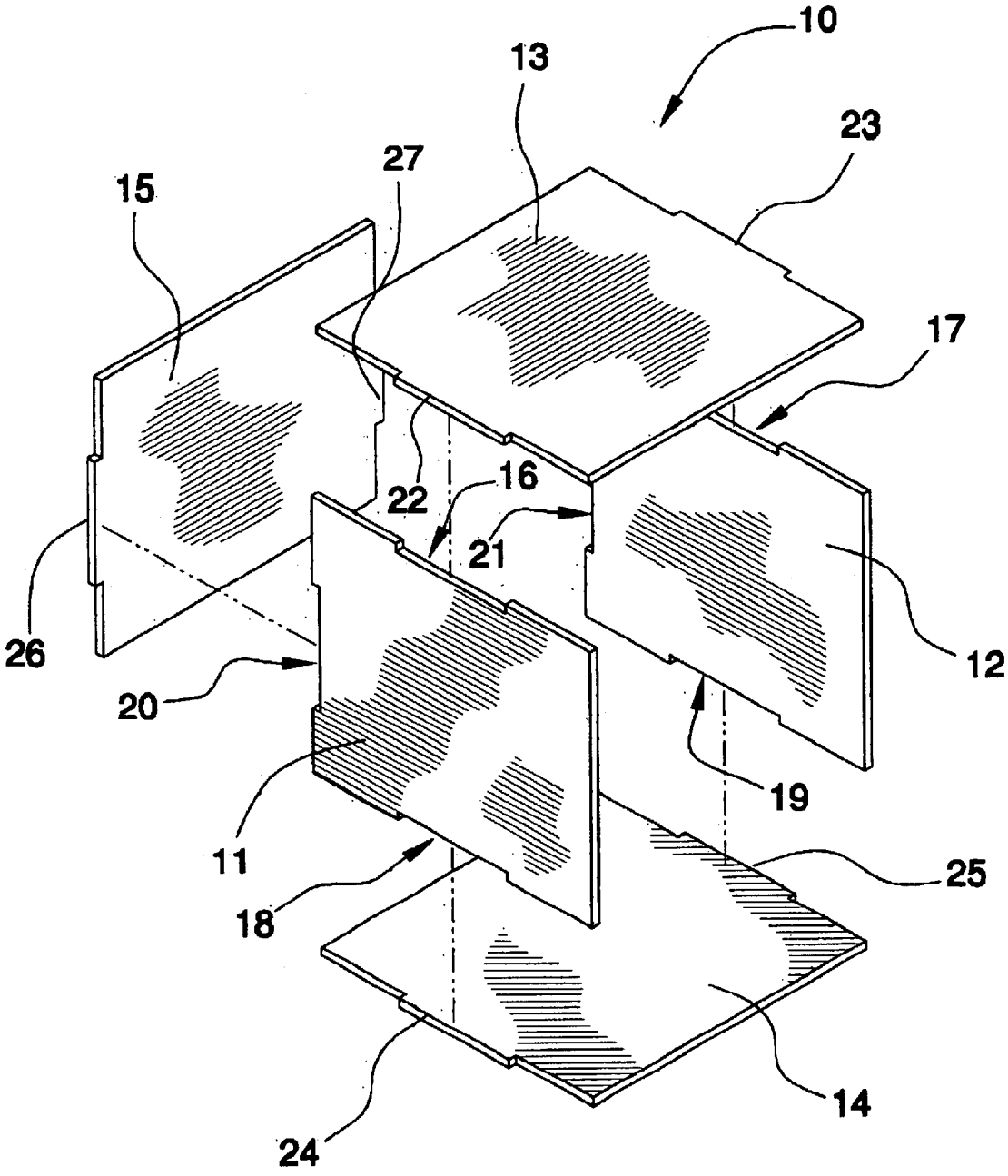
FIG. 2 is an exploded perspective view of the present invention.
Figure 3:
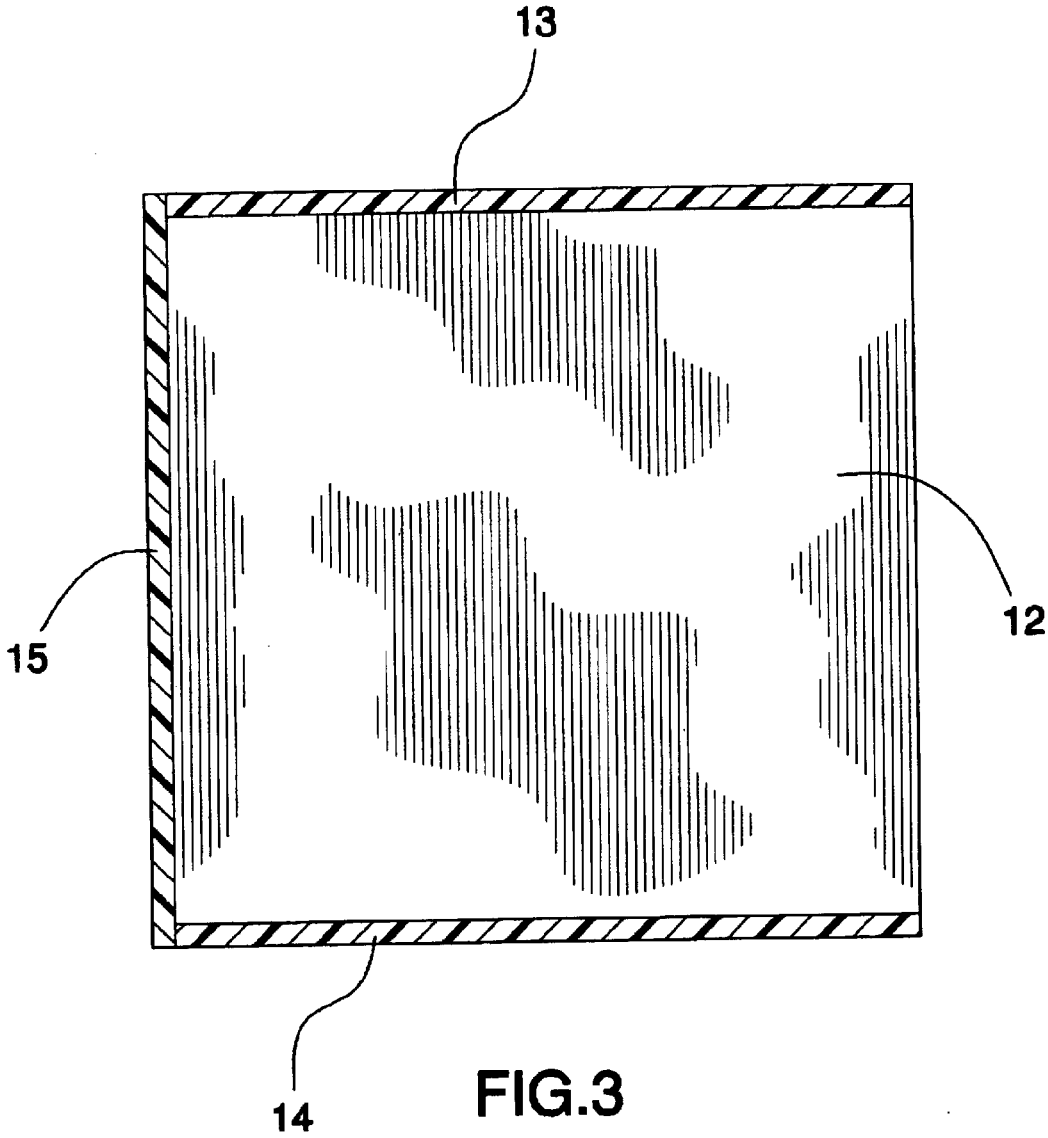
FIG. 3 is a cross-sectional view of the present invention.
Figure 4:
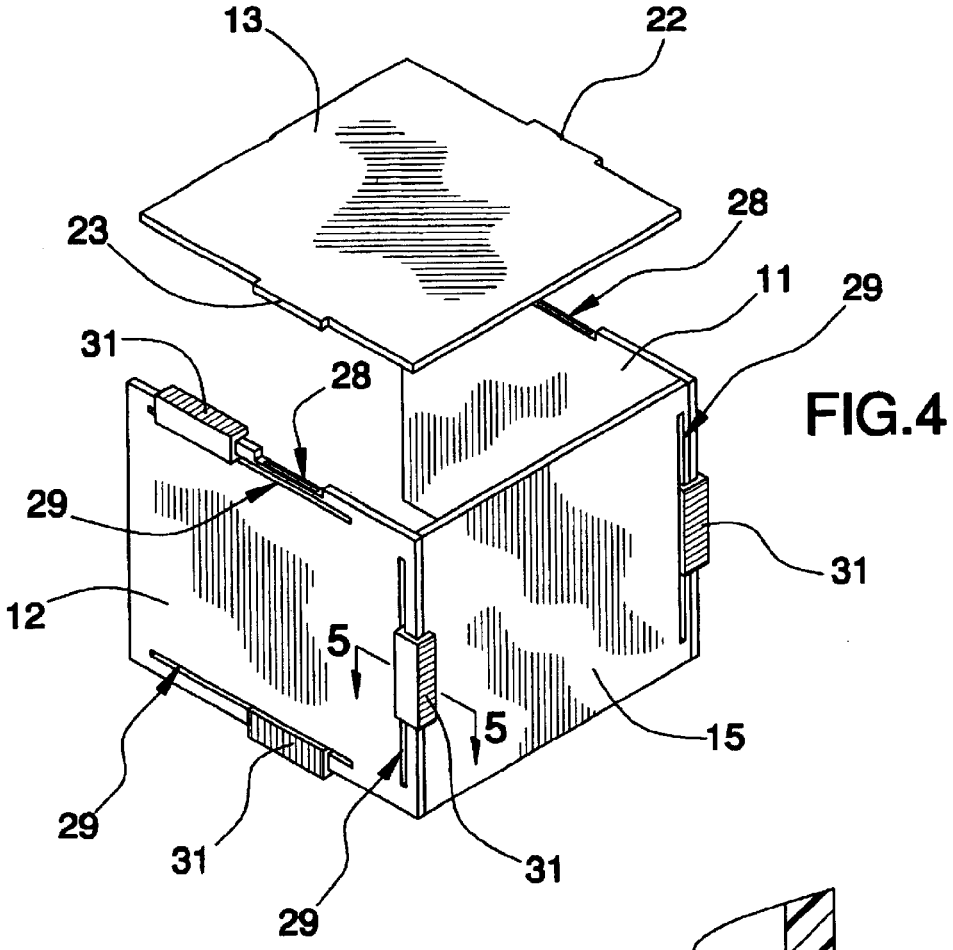
FIG. 4 is a partial exploded perspective view of a second embodiment of the present invention.
Figure 5:
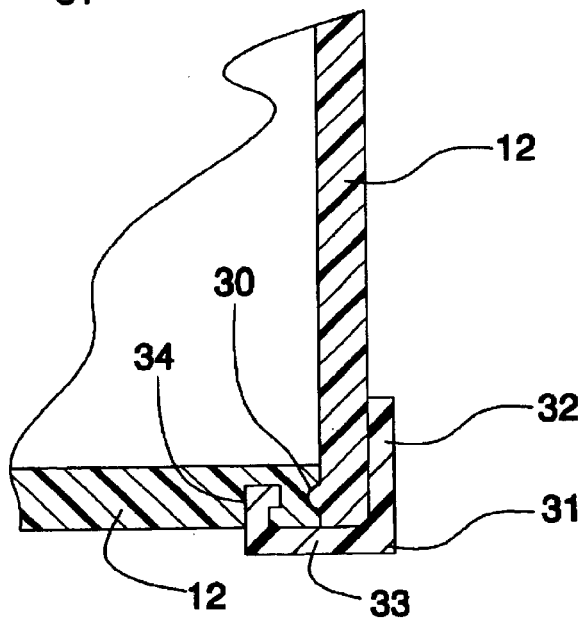
FIG. 5 is a partial cross-sectional view of the second embodiment of the present invention.
Figure 6:
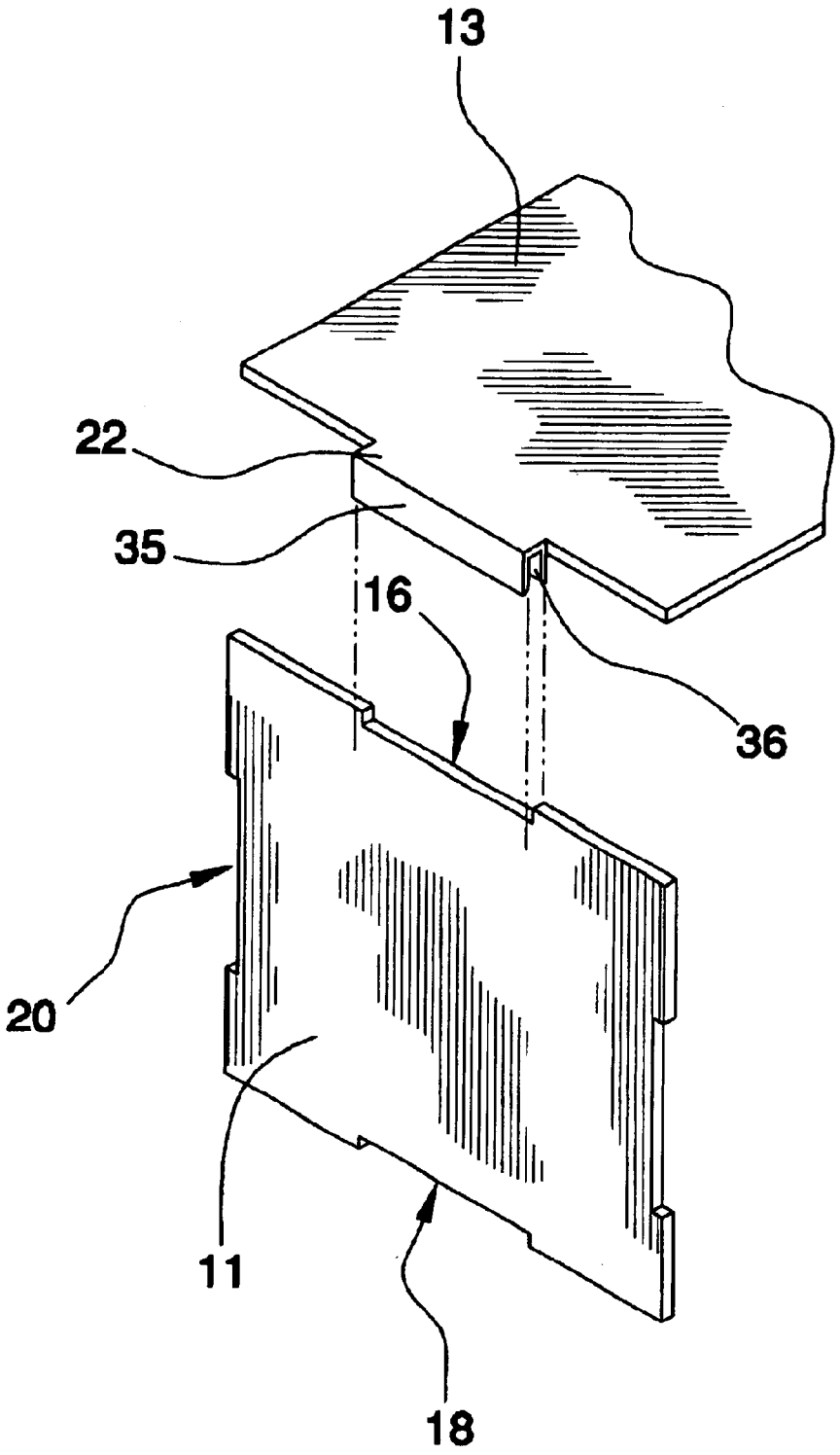
FIG. 6 is a partial exploded perspective view of a third embodiment of the present invention.

With reference now to the drawings, and in particular to FIGS. 1 through 6 thereof, a new microwave oven food & drink enclosure assembly embodying the principles and concepts of the present invention and generally designated by the reference numeral 10 will be described.

As best illustrated in FIGS. 1 through 6, the microwave oven food & drink enclosure assembly 10 generally comprises a plurality of panels 11–15 being detachably attached to form an enclosure in which food and drink can be supported in a microwave oven to keep interior walls of the microwave oven clean during the use thereof. The plurality of panels 11–15 includes a pair of side panels 11,12, a back panel 15, a top panel 13, and a bottom panel 14 with the enclosure having an open front. The plurality of panels 11–15 are made of plastic.

A means of connecting the panels together includes the side panels 11,12 having top, bottom, and back edges, and also having recessed portions 16–21 being centrally-disposed in the top, bottom, and back edges thereof; and also includes the top, bottom, and back panels 13–15 having side edges, and also having tabs 22–27 being centrally-disposed along and integrally extended from the side edges thereof and being removably received in the recessed portions 16–21 of the side panels 11,12 to form the enclosure.

As a second embodiment, the side panels 11,12 have grooves 28 being conventionally disposed in edges and extending a length of the recessed portions 16–21, and also have elongate slots 29 being disposed in outer sides of the side panels 11,12 near the recessed portions 16–21 and extending generally parallel to the top, back and bottom edges of the side panels 11,12; and the tabs 22–27 of the top, bottom, and back panels 13–15, have ribs 30 being conventionally disposed upon sides thereof and being removably received in the grooves 28 of the side panels 11,12. The means of connecting the panels together further includes latches 31 being slidably disposed in the elongate slots 29 of the side panels 11,12 and being engageable to the tabs 22–27 for retaining the top, bottom, and back panels 13–15 to the side panels 11,12. Each of the latches 31 includes a planar end portion 32 which is removably engageable to a respective tab 22–27, and also includes a planar intermediate portion 33 which is angled approximately 90 degrees relative to the planar end portion 32, and further includes an L-shaped end portion 34 which is angled relative to the planar intermediate portion 33 and which is slidably retained in a respective elongate slot 29.

As a third embodiment, each of the tabs 22–27 includes a pair of side panel engagement members 35,36 being spaced apart and conventionally extending outwardly from a respective tab 22–27 and forming a gap between each other with a respective recessed portion 16–21 being removably and engageably received in the gap to form the enclosure.

In use, the user attaches the panels 11–15 together and places the enclosure in the microwave oven with the open front facing towards the front of the microwave oven. The user than places food and drinks in the enclosure and turns on the microwave oven which cooks the food and heats the drinks. After which, the user removes the enclosure and detaches the panels 11–15 and washes and cleans the panels 11–15 either in a dishwasher or in the kitchen sink to remove any splatters from the food and drinks.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the microwave oven food & drink enclosure assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A microwave oven food & drink enclosure assembly comprising:

a plurality of panels being detachably attached to form an enclosure in which food and drink can be supported in a microwave oven to keep interior walls of the microwave oven clean during the use thereof, said plurality of panels including a pair of side panels, a back panel, a top panel, and a bottom panel with said enclosure having an open front, said plurality of panels being made of plastic; and a means of connecting said panels together including said side panels having top, bottom, and back edges, and also having recessed portions being centrally-disposed in said top, bottom, and back edges thereof; and also including said top, bottom, and back panels having side edges, and also having tabs being centrally-disposed along and extended from said side edges thereof and being removably received in said recessed portions of said side panels to form said enclosure.

2. The microwave oven food & drink enclosure assembly as described in claim 1, wherein said side panels further have grooves being disposed in an edge and extending a length of said recessed portions, and also have elongate slots being disposed in outer sides of said side panels near said recessed portions and extending generally parallel to said top and bottom edges of said side panels; and said tabs of said top, bottom, and back panels, have ribs being disposed upon sides thereof and being removably received in said grooves of said side panels.

3. The microwave oven food & drink enclosure assembly as described in claim 2, wherein said means of connecting said panels together further includes latches being slidably disposed in said elongate slots of said side panels and being engageable to said tabs for retaining said top, bottom, and back panels to said side panels.

4. The microwave oven food & drink enclosure assembly as described in claim 3, wherein each of said latches includes a planar end portion which is removably engageable to a respective said tab, and also includes a planar intermediate portion which is angled approximately 90 degrees relative to said planar end portion, and further includes an L-shaped end portion which is angled relative to said planar intermediate portion and which is slidably retained in a respective said elongate slot.

5. The microwave oven food & drink enclosure assembly as described in claim 1, wherein each of said tabs includes a pair of side panel engagement members being spaced apart and extending outwardly from a respective said tab and forming a gap between each other with a respective said recessed portion being removably and engageably received in gap to form said enclosure.

* * * * *